US009482481B2

(12) United States Patent
Lavalley et al.

(10) Patent No.: US 9,482,481 B2
(45) Date of Patent: Nov. 1, 2016

(54) PUSH-LEVER MAGAZINE RELEASE FOR CONVERTING A CARBINE FROM CLAMSHELL MAGAZINES TO REMOVABLE MAGAZINES

(71) Applicants: Jason Lavalley, Winnipeg (CA); Roland Ward, Winnipeg (CA)

(72) Inventors: Jason Lavalley, Winnipeg (CA); Roland Ward, Winnipeg (CA)

(73) Assignee: SEVEN SIX TWO SYSTEMS, Winnipeg, Manitoba (CA)

( * ) Notice: Subject to any disclaimer, the term of this patent is extended or adjusted under 35 U.S.C. 154(b) by 0 days.

(21) Appl. No.: 14/806,311

(22) Filed: Jul. 22, 2015

(65) Prior Publication Data

US 2015/0345886 A1 Dec. 3, 2015

(51) Int. Cl.
*F41A 17/38* (2006.01)
*F41A 9/64* (2006.01)

(52) U.S. Cl.
CPC ..... *F41A 17/38* (2013.01); *Y10T 29/49819* (2015.01)

(58) Field of Classification Search
CPC ..... F41A 9/01; F41A 9/24; F41A 9/59; F41A 9/61; F41A 9/64; F41A 9/65; F41A 17/38
USPC ..... 42/11, 17, 18, 21, 24, 29, 33, 35, 37, 42/39, 7, 6, 49.01; 89/33.1
See application file for complete search history.

(56) References Cited

U.S. PATENT DOCUMENTS 808,938 A * 1/1906 Mauser ..... F41A 9/65 42/50
875,209 A * 12/1907 Prinke ..... F41A 3/82 42/136
904,646 A * 11/1908 Prinke ..... F41A 19/30 42/18

(Continued)

OTHER PUBLICATIONS

EJ Tool & Machine, AK style SKS Magazine Release, Jul. 8, 2015, http://www.youtube.com/watch?v=NMWF917HNMw.

(Continued)

*Primary Examiner* — Bret Hayes
*Assistant Examiner* — Derrick Morgan
(74) *Attorney, Agent, or Firm* — Kyle R. Satterthwaite; Ryan W. Dupuis; Ade & Company Inc.

(57) ABSTRACT

A magazine release for installation on a carbine in place of an original sliding latch enables use of removable magazines in place of an original clamshell magazine. The magazine release features a support member having an upper portion coupled to a trigger assembly frame of the carbine in place of the original sliding latch. A lever is pivotally supported on the support member at a lower portion thereof carried beneath the trigger assembly frame. The lever is pivotal about an axis that lies transversely of a longitudinal barrel direction of the carbine, and is manually pivotable in a release direction moving a catch feature rearwardly in the longitudinal barrel direction out of a default positon into which said catch feature is biased forwardly so as to catch under a retention feature of the removable magazine. The catch feature normally retains the removable magazine in place until the lever is pivoted in the release direction.

20 Claims, 6 Drawing Sheets

(56) References Cited

U.S. PATENT DOCUMENTS 1,396,949 A * 11/1921 Eickhoff ..... F41A 3/26 42/16
1,427,097 A * 8/1922 Feederle ..... F41A 3/38 89/132
1,548,709 A * 8/1925 Browning ..... F41A 35/02 42/18
2,382,410 A * 8/1945 Garand ..... F41A 17/38 89/145
2,386,205 A * 10/1945 Garand ..... F41A 3/32 42/18
2,550,280 A * 4/1951 Martin ..... F41A 15/14 42/69.02
2,557,144 A * 6/1951 Schaich ..... F41A 5/16 42/50
2,568,198 A * 9/1951 Loomis ..... F41A 17/38 89/140
2,628,536 A * 2/1953 Schaich ..... F41A 3/26 42/69.02
2,710,476 A * 6/1955 Garand ..... F41A 17/38 42/18
2,736,977 A * 3/1956 Harvey ..... F41A 17/38 42/18
2,765,558 A * 10/1956 Roper ..... F41A 17/38 42/18
2,765,562 A * 10/1956 Roper ..... F41A 17/46 42/18
2,829,563 A * 4/1958 Butler ..... F41A 15/14 42/25
2,997,803 A * 8/1961 Florence ..... F41A 9/70 42/18
3,362,095 A * 1/1968 Byer ..... F41A 11/02 42/106
3,377,730 A * 4/1968 Lewis ..... F41A 3/18 42/16
3,415,000 A * 12/1968 Koucky ..... F41A 17/38 42/18
4,056,038 A * 11/1977 Rath ..... F41A 5/18 42/16
4,237,638 A * 12/1980 Trexler ..... F41A 11/02 42/6
4,450,641 A * 5/1984 Bullis ..... F41A 9/65 42/18
4,484,404 A * 11/1984 Johnson ..... F41A 17/38 42/18
4,523,510 A * 6/1985 Wilhelm ..... F41A 19/33 89/141
4,567,810 A * 2/1986 Preston ..... F41A 17/38 89/142
5,685,101 A * 11/1997 Ferretti ..... F41A 9/65 42/18
5,765,302 A * 6/1998 Brandl ..... F41A 9/55 42/18
5,771,620 A * 6/1998 Crawford ..... F41A 9/41 42/19
5,899,013 A * 5/1999 Hauser ..... F41A 17/38 42/6
6,101,918 A * 8/2000 Akins ..... F41A 19/03 89/129.01
8,434,253 B2 * 5/2013 Cain ..... F41A 17/38 42/49.01
9,080,822 B2 * 7/2015 Lamb ..... F41A 9/01
2004/0103777 A1 * 6/2004 Moore ..... F41A 3/22 89/130
2006/0265925 A1 * 11/2006 Murello ..... F41A 17/38 42/70.01
2011/0010977 A1 * 1/2011 Cash ..... F41A 9/65 42/50
2011/0099869 A1 * 5/2011 Bentley ..... F41A 9/65 42/6
2012/0255209 A1 * 10/2012 Klassen ..... F41A 9/71 42/6
2013/0104440 A1 * 5/2013 Addis ..... F41A 17/38 42/90
2014/0137453 A1 * 5/2014 Lamb ..... F41A 9/01 42/6
2014/0230297 A1 * 8/2014 Larson, Jr. ..... F41A 17/38 42/6
2014/0325886 A1 * 11/2014 Mather ..... F41A 17/38 42/6
2015/0033608 A1 * 2/2015 Power ..... F41A 9/59 42/6
2015/0198394 A1 * 7/2015 Hochstrate ..... F41A 3/26 42/17
2015/0345886 A1 * 12/2015 Lavalley ..... F41A 17/38 42/6

OTHER PUBLICATIONS

EJ Tool & Machine, AK Style SKS Mag Release, Jul. 10, 2015, http://www.gofundme.com/sksmagrelease.

* cited by examiner

FIG. 4A
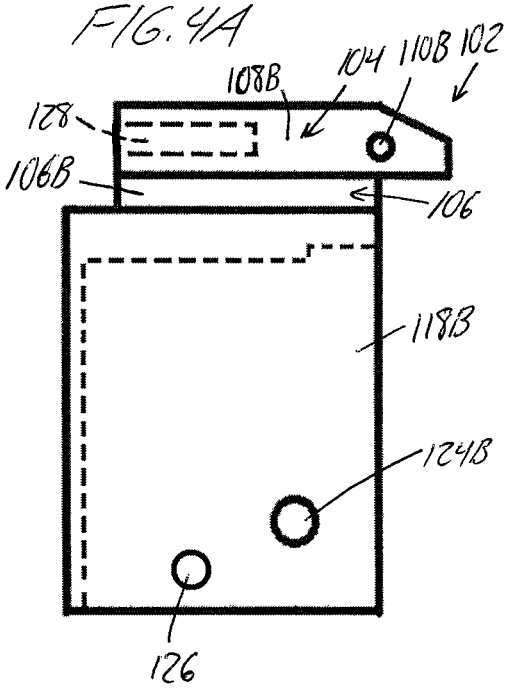
FIG. 4B
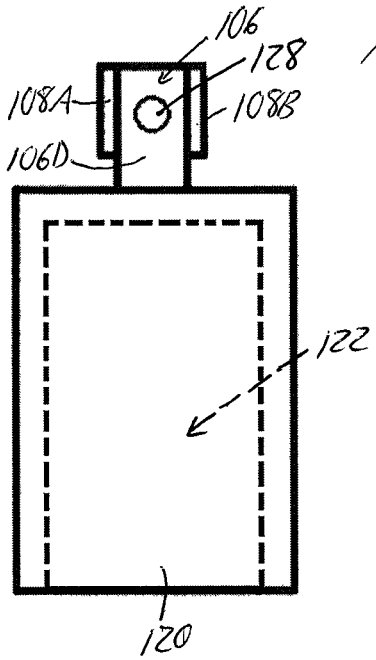
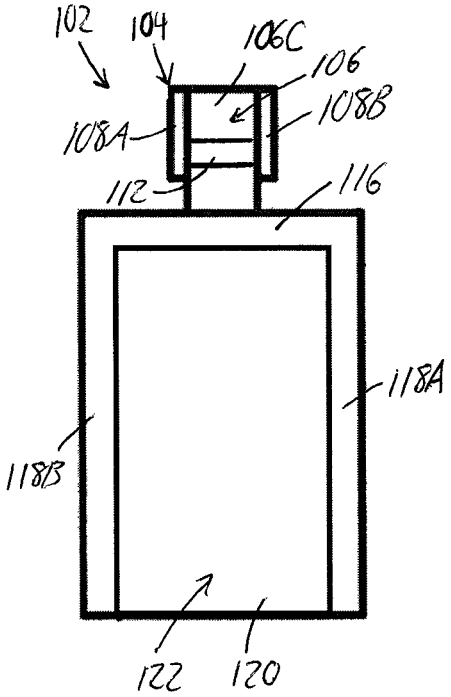
FIG. 4C
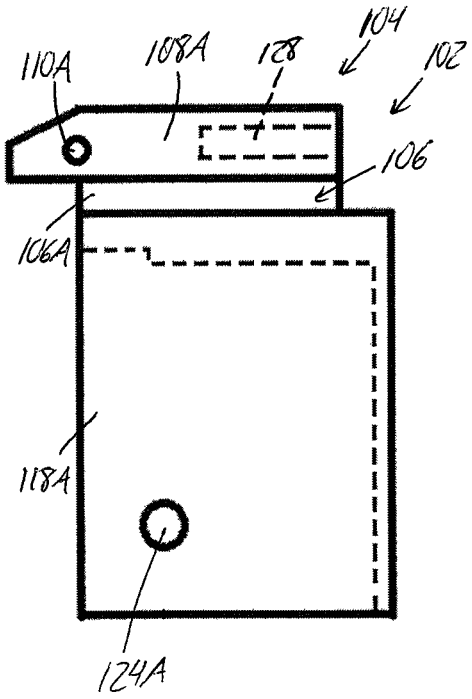
FIG. 4D

PUSH-LEVER MAGAZINE RELEASE FOR CONVERTING A CARBINE FROM CLAMSHELL MAGAZINES TO REMOVABLE MAGAZINES

FIELD OF THE INVENTION

The present invention relates generally to firearms, and more particularly to a push-lever magazine release mountable in place of a sliding latch of an SKS type carbine to enable single-handed removal and loading of detachable magazines.

BACKGROUND

The SKS-45 Carbine was originally designed with a fixed 10 round, box magazine that opens and closes like a clamshell, rather than being removed, for reloading purposes. To date companies have tried to remedy this with the introduction of detachable magazines that be used in place of the original clamshell magazine while relying on the same sliding latch that held the original magazine closed to temporarily hold the now-removable magazine in place. While the concept behind this modification was good, a major drawback is that a user cannot change the magazine without breaking his or her grip on the fire control. That is, the removal of the empty magazine requires using one hand to pull the slide latch rearwardly away from the magazine toward the trigger guard, and use of the other hand to pull the detachable magazine out its engaged position in the stock. The current magazine changing process is therefore a cumbersome two handed operation.

Applicant has developed a unique push-lever magazine release that can be easily installed in place of the original slide latch to enables one-handed removal of a detachable magazine with little or no modification to the remaining original equipment.

SUMMARY OF THE INVENTION

According to one aspect of the invention there is provided a magazine release for installation on a carbine in place of an existing sliding latch for an original clamshell magazine of said carbine to enable use of a removable magazine in place of said clamshell magazine, the magazine release comprising:

a support member having an upper portion configured for coupling to a trigger assembly frame of the carbine in place of the existing sliding latch;

a lever pivotally supported on the support member at a lower portion thereof disposed beneath the upper portion so as to carry the lever beneath the trigger assembly frame of the carbine, the lever being pivotal about an axis that lies transversely of a longitudinal barrel direction of the carbine when the support member is coupled thereto, and the lever being manually pivotable in a release direction moving a catch feature rearwardly in the longitudinal barrel direction out of a default positon into which said catch feature is biased forwardly in the longitudinal barrel direction toward a magazine-accepting opening in the carbine to catch under a retention feature of the removable magazine received therein, whereby the catch feature normally retains the removable magazine in place until the lever is pivoted in the release direction.

Preferably the upper portion of the support member comprises a transverse through-hole therein that lies transversely of the longitudinal barrel direction of the carbine when the support member is coupled thereto, the transverse through-hole being sized to accommodate receipt of a latch stop pin of the carbine in order to couple the support member to the trigger assembly frame of the carbine.

Preferably the upper portion of the support member comprises a longitudinal bore therein that lies parallel to the longitudinal barrel direction of the carbine when the support member is coupled thereto, the longitudinal bore extending into the upper portion of the support member from a rear end thereof that faces away from the magazine-accommodating opening of the carbine in the longitudinal barrel direction thereof, the longitudinal bore being sized to accommodate receipt of a sear spring of the carbine therein.

Preferably an upper end of the lever defines the catch feature.

Preferably the lever is rotationally biased in a default direction that is opposite to the release direction and urges the upper end of the lever forwardly in the longitudinal barrel direction.

Preferably there is provided a spring biasing the lever in the default direction around said axis.

Preferably the support member comprises a neck that joins the upper and lower portions together and is narrower than said upper and lower portions in a width dimension of the support member that lies transversely of the longitudinal barrel direction when the support member is coupled to the carbine.

Preferably the support member and the lever comprise cooperating stop features that limit pivoting of the lever in the default direction to define a default position of the lever in which the lever catches under the retention feature of the removable magazine.

Preferably the lower portion of the support member comprises an interior cavity bound by two side walls and a rear wall spanning therebetween at a rear end of the cavity that lies opposite to a front end thereof from which the upper end of the lever normally projects, the lever having a stop thereon that abuts against the rear wall of the interior cavity in the default position.

According to a second aspect of the invention, in a carbine originally having a clamshell magazine retained in a closed position by a sliding latch, a magazine release installed in place of said sliding latch to enable use of a removable magazine in place of said clamshell magazine, said magazine release comprising:

a support member having an upper portion coupled to a trigger assembly frame of the carbine in place of the sliding latch adjacent a rear end of a magazine-accommodating opening of the carbine;

a lever pivotally supported on the support member at a lower portion thereof disposed beneath the trigger assembly frame of the carbine, the lever being manually pivotable in a release direction moving a catch feature rearwardly in the longitudinal barrel direction out of a default positon into which said catch feature is biased forwardly toward the magazine-accepting opening to catch under a retention feature of the removable magazine when received therein, whereby the catch feature normally retains the removable magazine in place until the lever is pivoted in the release direction.

According to a third aspect of the invention, there is provided a method of adapting a carbine with a clamshell magazine for use removable magazines, the method comprising replacing an existing sliding latch of the carbine with a push-lever magazine release.

Preferably the method includes coupling a support member of the push-lever magazine release to a trigger assembly frame of the carbine by inserting a cross-pin through the support member at an existing cross-pin hole of the trigger assembly frame.

Preferably the method includes inserting a sear spring of the carbine into a blind hole at a rear side of a stationary support member portion of the push-lever magazine release.

According to a fourth aspect of the invention, there is provided a lever support for a magazine release to be installed on a carbine in place of an existing sliding latch for an original clamshell magazine of said carbine to enable use of a removable magazine in place of said clamshell magazine, the lever support comprising an upper portion configured for coupling to a trigger assembly frame of the carbine in place of the existing sliding latch, and a lower portion disposed beneath the upper portion for pivotal support of a lever of said magazine release, the upper portion of the support member having a transverse through-hole therein that lies transversely of the longitudinal barrel direction of the carbine when the support member is coupled thereto, the transverse through-hole being sized to accommodate receipt of a latch stop pin of the carbine in order to couple the support member to the trigger assembly frame of the carbine.

According to a fifth aspect of the invention there is provided a magazine release for installation on a carbine in place of an existing sliding latch for an original clamshell magazine of said carbine to enable use of a removable magazine in place of said clamshell magazine, the magazine release comprising:

a support member having an upper portion configured for coupling to a trigger assembly frame of the carbine in place of the existing sliding latch;

a lever pivotally supported on the support member at a lower portion thereof disposed beneath the upper portion so as to carry the lever beneath the trigger assembly frame of the carbine, the lever being pivotal about an axis that lies transversely of a longitudinal barrel direction of the carbine when the support member is coupled thereto, and the lever being rotationally biased about said axis in a first direction urging an upper end of the lever forwardly in the longitudinal barrel direction toward a magazine-accepting opening in the carbine to catch under a retention feature of the removable magazine received therein, whereby the lever normally retains the removable magazine in place until the lever is manually pivoted in a second direction opposite the first direction in which the lever is biased.

According to a sixth aspect of the invention, in a carbine originally having a clamshell magazine retained in a closed position by a sliding latch, a magazine release is installed in place of said sliding latch to enable use of a removable magazine in place of said clamshell magazine, said magazine release comprising:

a support member having an upper portion coupled to a trigger assembly frame of the carbine in place of the sliding latch adjacent a rear end of a magazine-accommodating opening of the carbine;

a lever pivotally supported on the support member at a lower portion thereof disposed beneath the trigger assembly frame of the carbine, the lever being pivotal about an axis lying transversely of a longitudinal barrel direction of the carbine, and the lever being rotationally biased about said axis in a first direction urging an upper end of the lever forwardly toward the magazine-accepting opening to catch under a retention feature of the removable magazine when received therein, whereby the lever normally retains the removable magazine in place until the lever is manually pivoted in a second direction opposite the first direction in which the lever is biased.

BRIEF DESCRIPTION OF THE DRAWINGS

One embodiment of the invention will now be described in conjunction with the accompanying drawings in which:

FIGS. 4A, 4B, 4C and 4D are right side, rear, front and left side elevational views, respectively, of a support member of the magazine release of FIG. 3.

In the drawings like characters of reference indicate corresponding parts in the different figures.

DETAILED DESCRIPTION

Figure 1:
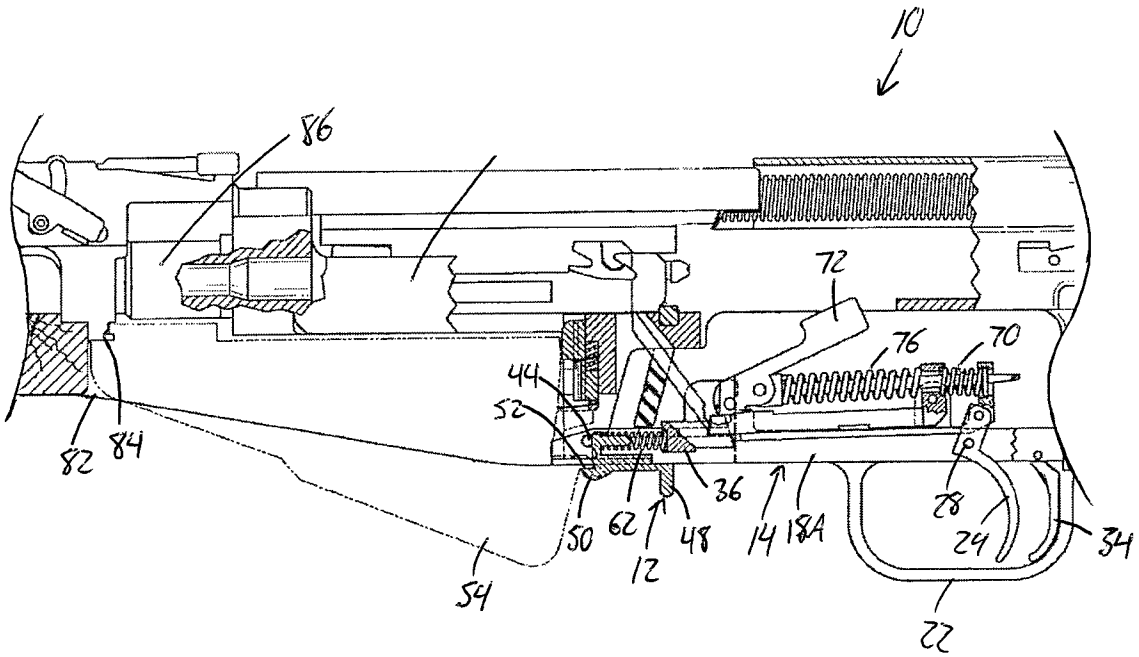
FIG. 1 PRIOR ART
FIG. 1 is a partially sectioned side view of a conventional carbine of the type employing a fixed clamshell magazine that is not removed during reloading.
Figure 2:
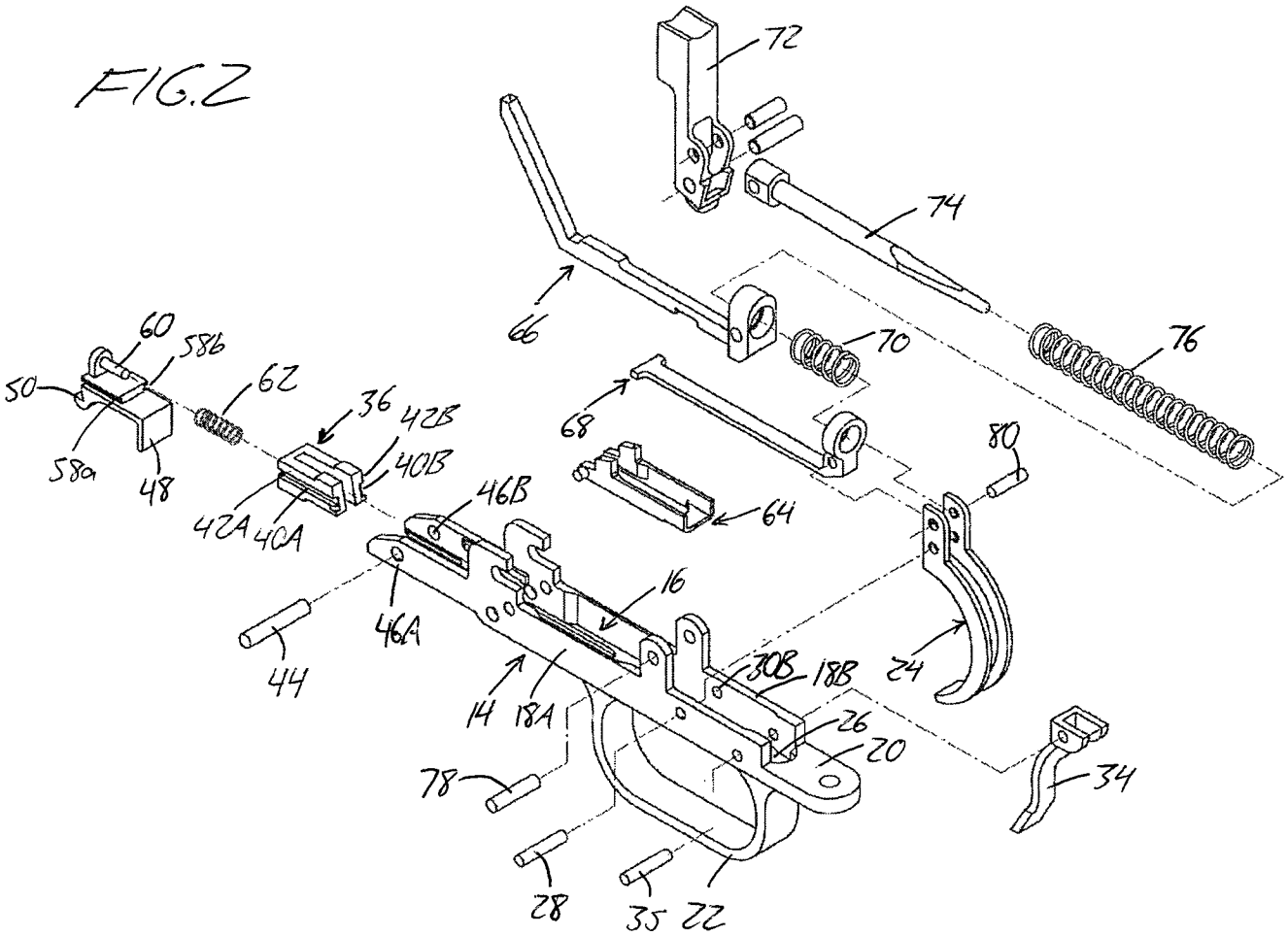
FIG. 2 PRIOR ART
FIG. 2 is an exploded perspective view of the trigger assembly of the conventional carbine of FIG. 1.

FIG. 1 illustrates a conventional SKS carbide 10 in which a slide latch 12 is slidingly mated with a frame member 14 of the trigger assembly, which is shown in an exploded state in FIG. 2. The frame member 14 has an upwardly directed channel cavity 16 delineated by side walls 18A and 18B that extend upwardly from a base plate 20. A trigger guard 22 extends downwardly from the underside of the base plate 20. The trigger 24 extends upwardly through an aperture 26 in the base plate 20 to be secured by a trigger pin 28 that extends across the channel cavity 16 to be supported in aligned bores 30A and 30B which penetrate the side walls 18A and 18B, respectively. The trigger pin 28 extends through transverse mounting bores 32A and 32B in the trigger 24. Operation of the trigger 24 is accomplished by selectively engaging the trigger finger on the shooter's hand with the trigger 24 in order to pivot the trigger 24 on the trigger pin 28. A safety 34 is mounted on a safety pivot pin 35 that is also supported from the side walls 18A and 18B.

A sear block 36 is slidably mounted on a pair of tongues that extend, in opposition, into the U-shaped channel cavity 16 from the side walls 18A and 18B of the trigger assembly frame member 14. The tongues are, respectively, received in grooves 40A and 40B which are recessed within, and extend longitudinally along, the side faces 42A and 42B of the sear block 36. The sear block 36 is thus slidable along the tongues, and the sear block 36 is retained within the frame member 40 by a cross pin 44 that extends transversely through aligned bores 46A and 46B in the respective side walls 18A and 18B of the trigger assembly frame member 14.

The cross pin 44 serves three functions. The first two of those three functions are that it retains the sear block 36 within the trigger assembly frame member 14; and retains the slide latch 12 within the trigger assembly frame member 14. The end portions of the cross pin 44 extend laterally outwardly from the side plates of the trigger assembly frame member 14, and are thereby employed to mount the trigger assembly to the combined receiver and barrel assembly of the carbine within a trigger assembly opening in the stock.

The slide latch 12 features a finger engaging flange 48 that extends downwardly from a rearward portion of the slide latch 12, and a catch 50 that extends downwardly from a forward portion of the slide latch 12 to releasably engage a mating latch rib 52 on the original clamshell magazine 54. The slide latch 12 is slidable longitudinally within the channel cavity 16 by the engagement of opposedly disposed rails which extend toward each other from the lower edges of the side walls 18A and 18B, respectively, of the trigger assembly frame member 14. The rails are slidably received within channels 58A and 58B on the sides of the slide latch 12. The cross pin 44, being located ahead of both the sliding sear block 36 and the slide catch 12, is often referred to as the sear or latch stop pin 118, as it limits forward sliding of these components and thereby prevents exit thereof from the channel of the trigger assembly frame member 14.

An aligning post 60 is cantilevered from, and extends rearwardly from the slide latch 12 in order to position and retain a sear spring 62, which engages the forward face 64 of the sear block 36 on a continuous basis in order to bias the sear block 36 rearwardly away from the slide latch 12. Other components of the conventional trigger assembly that are illustrated, but not pertinent to the present invention, include the auxiliary or rebound disconnector 64, the primary disconnector 66, the trigger transfer bar 68, the trigger transfer bar/disconnector spring 70, the hammer 72, the hammer strut 74, the hammer spring 76, the primary disconnector pin 78, and the transfer bar/trigger pin 80.

To open the bottom half of the clamshell magazine 54, the finger flange 48 of the slide latch 12 is pulled rearwardly toward the trigger guard 22 in the longitudinal direction of the trigger assembly frame member 14, which is parallel to the barrel of the carbine 10. This rearward displacement of the slide latch 12 releases the catch 50 from under the latch rib 52 at the rear end of the bottom half of the clamshell magazine 54. In prior art adaptation of the carbine for use with detachable magazines, the original clamshell magazine 54 was removed entirety, and a removable magazine was installed in its place for similar cooperation with the slide latch 12 to normally hold the removable magazine in place. The rearward sliding action needed to disengage the slide latch 12 from the magazine required the use of a separate hand from that which grips the removable magazine in order to withdraw same from the magazine-accommodating opening 82 in the stock of the carbine 10.

FIG. 3 illustrates the carbine of FIG. 1 after removal of the original clamshell magazine 54 and original slide latch 12, and replacement of the original slide latch 12 with a push-lever magazine release 100 according to the present invention. This magazine release 100 enables one-handed attachment and detachment of a removable magazine 200. The illustrated removable magazine 200 is of a conventional, commercially available type often referred to as a duckbill magazine due the duckbill-like appearance of a forward-reaching projection 202 extending forwardly from the ammunition compartment 204 near the upper end thereof to engage with an existing anchor hook 84 which projects downwardly from the barrel 86 thereof at the front end of the magazine-accommodating opening 82 of the stock. The front end of the duckbill projection 202 features a notch or slot disposed beneath a forward-jutting flange 206 so that the anchor hook 84 is receivable in the slot beneath the forward flange 206 during insertion of the magazine to the opening in the stock. As a result, the forward flange 206 of the removable magazine hooks over the anchor hook 84 of the carbine in the installed position of the removable magazine in the same way as the upper half of the original clamshell magazine 54.

Alternatively, the present invention may be used with a non-duckbill removable magazine, for example by installing an adapter at the front of the magazine-accommodating opening 82 in place of, or in cooperation with, the original anchor hook 84 so as to reach further back into the magazine-accommodating opening to eliminate the need for the lengthy duck-bill extension on the magazine itself. Such adapters, and information concerning modification of duck-bill magazines for cooperation therewith, can be found at http://www.thesksmagadapter.com/our-products/. The commercially available removable magazines for the SKS carbine, both in in their original duckbilled and modified duckbill-less forms, feature a retention tab 208 projecting rearward from the ammunition compartment 204 at the rear side thereof, which conventionally rests atop the catch 50 of the original slide latch 12 in the normal default position of the spring latch that is forwardly biased by the sear spring 62, whereby the slide latch 12 holds the detachable magazine in place until the slide latch is once again pulled rearward to enable removal of the detachable magazine 200.

The magazine release 100 of the present invention features a support member 102 for mounting to the trigger assembly frame member 14 in place of the original slide latch 12, and a lever 103 pivotally supported on the support member 102 for cooperation with the retention tab 208 of the detachable magazine 200 to hold it in place. The support member 102 features an upper portion 104 adapted for coupling to the trigger assembly frame member 14 using the existing latch stop cross-pin 44 thereof, thereby avoiding any need to modify the carbine to accommodate the magazine release 100. The upper portion 104 of the illustrated embodiment features a solid metal block 106 of generally rectangular volume, and a pair of side plates 108A, 108B affixed to the metal block 106 on either side thereof. The solid block 106 has a length that exceeds its width and height dimensions, and that lies parallel to the longitudinal direction of the carbine in the installed position of the magazine release 100. The side plates 108A, 108B are flush-mounted to the elongated sides 106A, 106B of the solid block 106. Each side plate 108A, 108B has a length slightly exceeding that of the solid block 106, and a height that is less than that of the solid block. The two plates are identical to, and aligned with, one another in a position placing a top edge of each plate 108A, 108B flush with the topside of the block 106.

At a front end 106C of the block that faces forwardly toward the magazine-accommodating opening 82 in the installed position of the magazine release, the two plates 108A, 108B extend beyond the end of the block so as to reach forwardly therefrom. Respective circular holes 110A, 110B in the side plates 108A, 108B align with one another at a position partially overlapping the front end 106A of the block, which features a semi-cylindrical recess 112 therein that shares the same radial measure and same radial center as the two circular holes 110A, 110B, whereby the circular holes 110A, 110B and semi-cylindrical recess 112 collectively define a transverse-through hole passing fully through the upper portion 104 of the support member 102 in the width direction of the block 106, which lies perpendicularly to the longitudinal dimension of the carbine in the installed position of the support member 100.

A lower portion 114 of the support member 102 features a rectangular top wall 116 affixed to the underside of the central block 106 of the upper portion, a pair of equally sized side walls 118A, 118B depending downwardly from the top wall 116 in parallel relation to one another at opposing side edges of the top wall, and a rectangular rear wall 120 depending downwardly from the rear end of the top wall and spanning between the two side walls. The top, rear and side walls of the lower portion 114 delimit a generally rectangular, hollow interior cavity 122 of the support member 102 in which the lever 103 is pivotally carried. The length, width and height of this interior cavity exceed those of the upper portion's central block 106, which is centered on the top wall 116 of the lower portion in the width direction. The front end 106C of the upper portion's central block 106 resides in the same plane as the open front end of the lower portion's interior cavity 122, whereby the opposing rear end of the central block 106 stops short of the rear end of the internal cavity 122 that is closed off by rear wall 120.

Respective circular holes 124A, 124B in the side walls 118A, 118B align with one another at position proximate to the lower front corners of these side walls 118A, 118B to define a tranverse through-bore passing fully through the lower portion of the support member 102 in a transverse direction parallel to that of the transverse through-hole in the upper portion. A blind longitudinal bore 128 extends into the central block 106 of the upper portion 104 of the support member 102 at a position between the two side plates 108A, 108B thereof so as to lie longitudinally of the carbine when the support member is installed thereon. A lower part of the central block 106 residing between the top wall 116 of the lower portion 114 and the bottom edges of the upper portion's side plates 108A, 108B defines a reduced-width neck of the support member that is narrower than the remainder of the support member in the width direction.

With reference to the assembled and installed magazine release 100 shown in FIG. 3, the top part of the support member's central block 106 that is widened relative to the neck by the attachment of the side plates 108A, 108B is received in the channel of the trigger assembly frame member 14 in place of the removed sliding latch 12. The cross-pin 44 previously used to limit the forward sliding of the original latch 12 instead passes through the transverse through-hole 110A, 110B, 112 of the upper portion 102 of the support member 102 in order to fix the support member to the trigger assembly frame member 14 in a stationary position. The reduced-width neck of the support member 102 depends downwardly from the trigger assembly frame member 114 between the rails of the frame member's side walls 18A, 118B at the front end of the base plate 20, whereby the lower portion 114 of the support member 102 is suspended beneath the trigger assembly frame member 114 at the front end thereof just behind the magazine-accommodating opening 82 in the stock of the carbine 10.

The lever 103 is pivotally carried within the internal cavity 122 of the support member 102 by a shaft 130 that traverses through the support member 102 in the width direction via the transverse through-bore formed by the holes 124A, 124B in the side walls 118A, 118B thereof. The lever 103 is therefore pivotal about the axis of the shaft 130, which lies perpendicularly transverse to the longitudinal direction of the carbine (i.e. parallel to the pivot axis of the trigger 24). A torsion spring 134 is coiled around the shaft 130, with one leg of the torsion spring 134 abutting against the lever 103 and the other leg of the torsion spring 134 abutting against the rear wall 120 of the support member's internal cavity 122.

FIG. 3 shows the lever 103 in a normal default position operable to hold the detachable magazine 200 in place on the carbine 10. The lever 103 features a main plate 136 that is flat over a substantial majority of its length, which lies perpendicular to the axis of through-shaft 130 on which the lever pivots. The width of the main plate 136 is less than its length so as to fit between the two side walls 118A, 118B of the support member's internal cavity 122. In the normal default position of the lever 103, the main plate 136 lies obliquely to the longitudinal axis of the carbine so that a forward upper end 103A of the lever 103 projects upwardly and forwardly through the open front side of the support member's internal cavity 122 in order to butt against the underside of the magazine's retention tab 208 and hold the magazine in place. The distal tip of the lever's upper end 103A thereby defines a catch feature that catches beneath the retention tab 2018 of the magazine in the spring-biased default position of the lever. In the lever's default position, the rear lower end 103B of the lever 103 projects rearwardly downward through the open bottom end of the support member's internal cavity 122 in order to make this end of the lever accessible outside the cavity 122 for manual pivoting of the lever out of this default magazine-holding position.

Figure 3A:
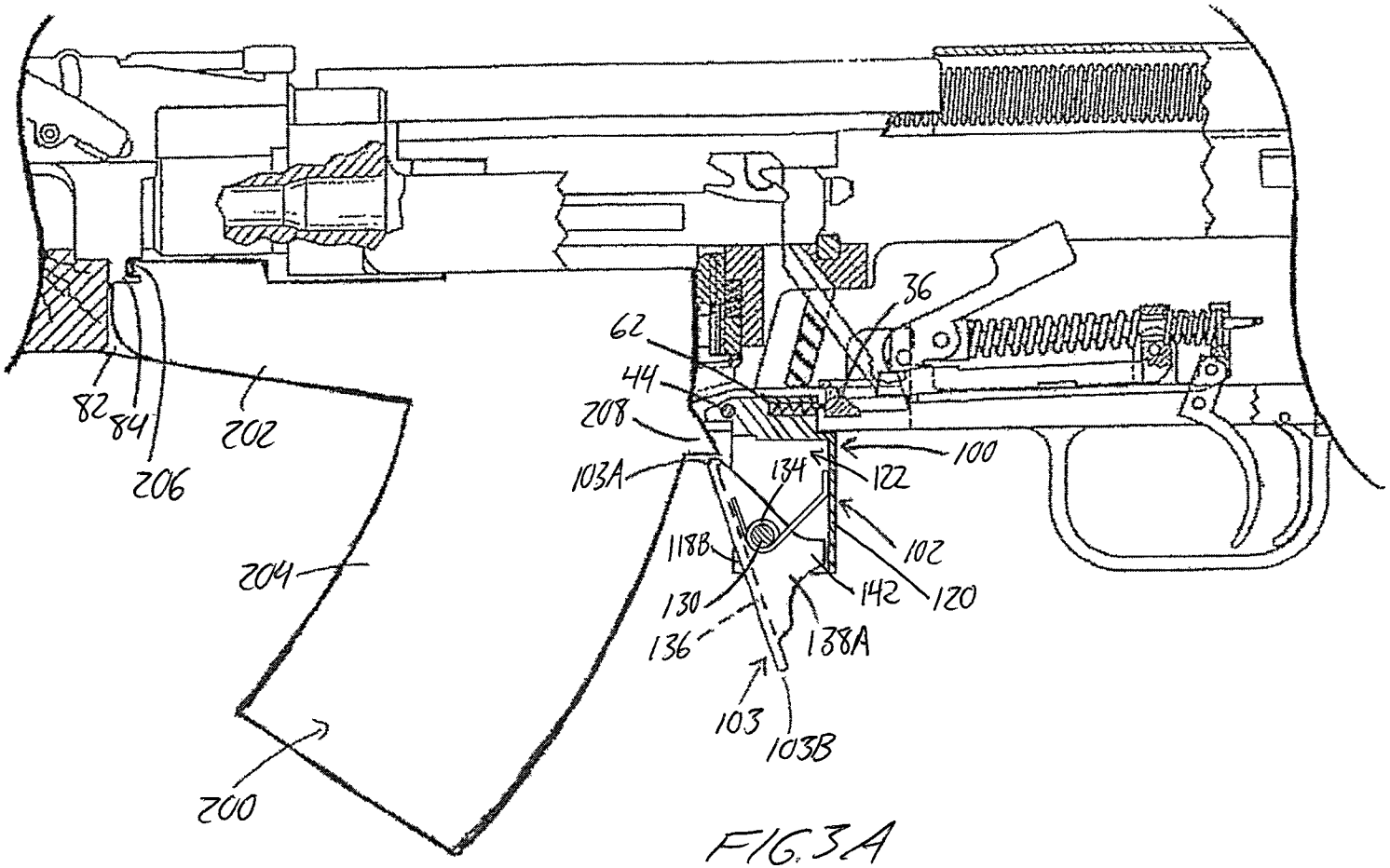
FIG. 3A is a partially sectioned side view of a carbine of the type shown in FIG. 1 having been adapted for use of removable box magazines by installation of a push-lever magazine release of the present invention in place of the original slide latch previously used to hold the clamshell magazine in its closed position.
Figure 3B:
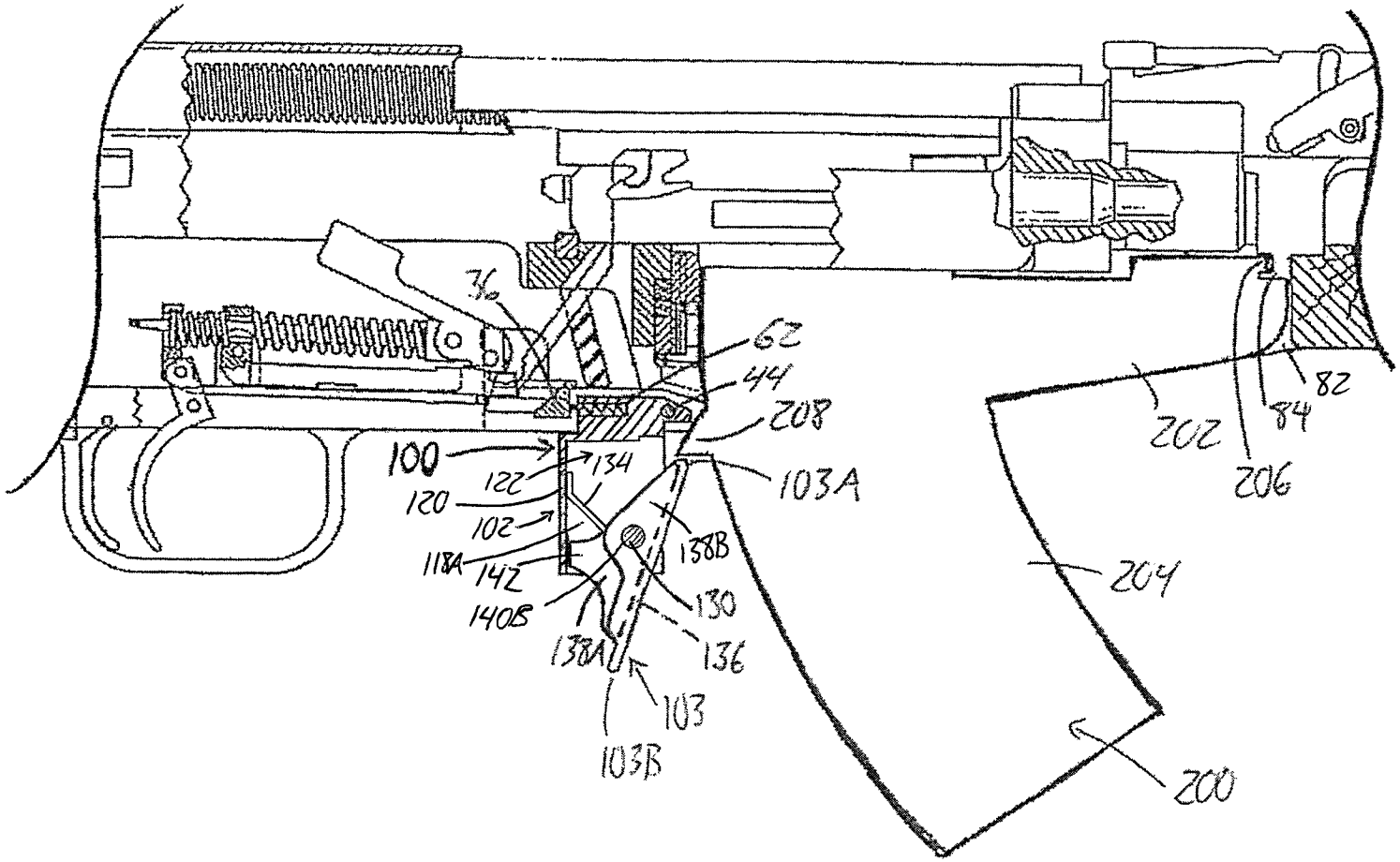
FIG. 3B is another partially section side view of the carbine of FIG. 3A from an opposing side thereof.
Figure 3C:
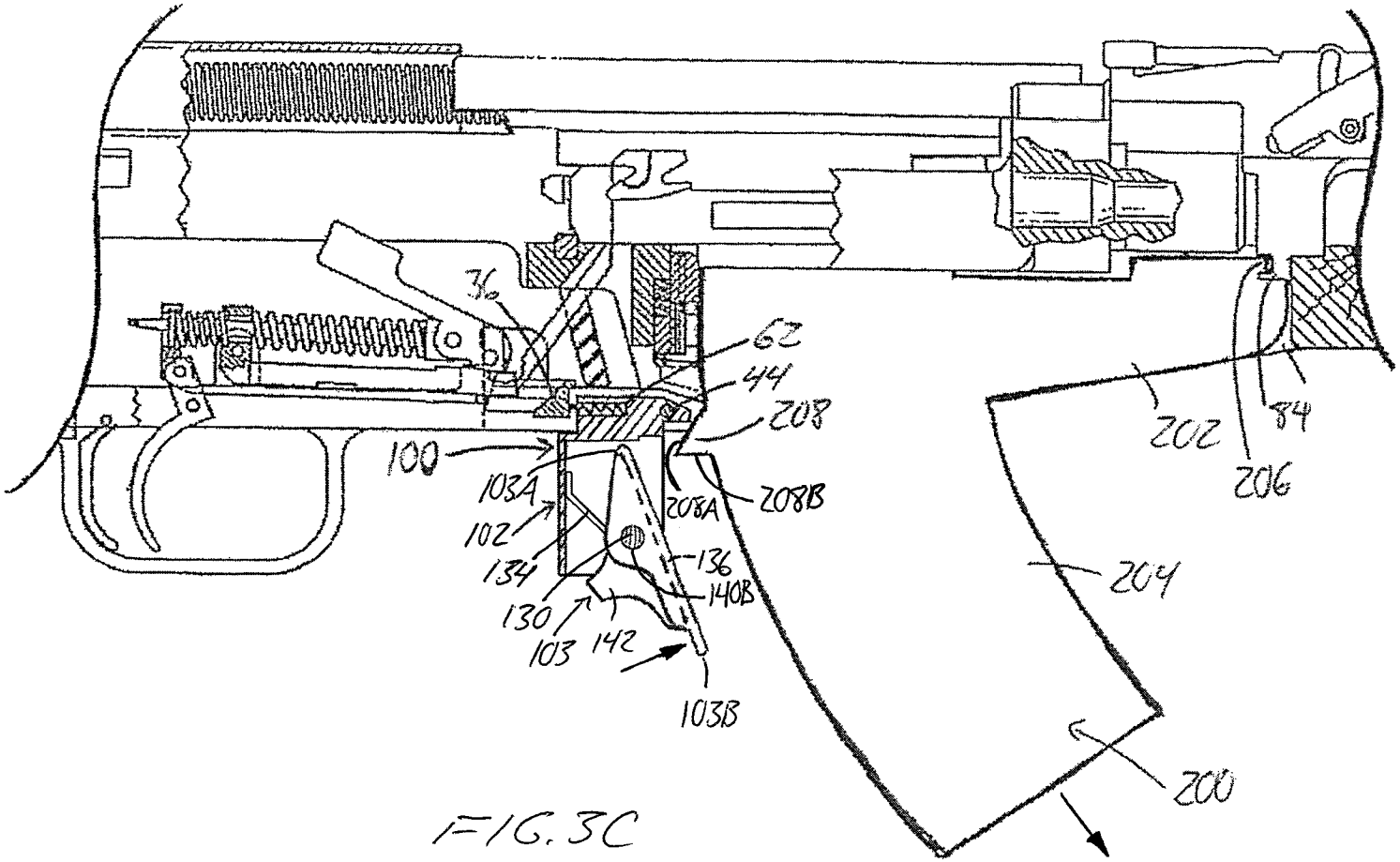
FIG. 3C is similar to FIG. 3B, but showing the lever of the magazine release in a release position disengaged from contact with the removable box magazine to allow withdrawal thereof from the carbine.

With reference to FIG. 3C, to remove the magazine 200, a user wraps the fingers of one hand around the ammunition compartment 204 of the magazine 200, and uses the thumb of the same hand to push the lower rear end 103B of the lever 103 forwardly out its normal position, thereby pivoting the catch feature at the forward upper end 103A of the lever 103 rearwardly into the internal cavity 122 of the support member 102. This action withdraws the catch feature at the forward upper end 103A of the lever rearwardly out from under the retention tab 208 of the magazine in order to enable withdrawal of the magazine from the stock of the carbine using the same hand. Throughout this process, the user's other hand is left entirely free to continue supporting carbine in a ready position at the trigger area.

The illustrated lever features two side plates 138A, 138B that lie parallel to one another in planes perpendicular to the lever's main plate 136 at the elongated side edges thereof. Aligned circular holes, one of which is shown at 140B, in these lever side plates 138A, 138B accommodate receipt of the shaft 130 during assembly of the magazine release 100 in order to pivotally mount the lever to the support member 102. The side plates 138A, 138B are rounded at their forward upper ends, where the main plate 136 deviates from its otherwise planar form to follow this curvature so that the forward upper edge of the main plate 136 spans between the two side plates 138A, 138B at the peak or apex of these rounded ends at the distal tip of the lever. Upper edge of the main plate at the distal tip of the lever thereby defines the catch feature atop which the retention tab 208 of the magazine is seated. From its rounded end, each side plate 138A, 138B of the lever 103 grows wider in its respective plane in order to define sufficient area for the respective shaft-accommodating hole 140B. One of the side plates 138B then tapers back down in a direction moving away from the respective hole toward the rear lower end 103B of the lever. The other side plate 138A reaches a point of greater wideness than the other so as to define a stop lug 142 that reaches radially further from the lever shaft 130 toward the rear wall 120 of the support member cavity 122 than the other areas of the lever side plates 138A, 138B.

The torsion spring 134 biases the lever 103 in a default direction urging the forward upper end 103A of the lever 103 forwardly through the open front end of the support member cavity 122 in order to bias the lever 103 into its normal position shown in FIGS. 3A and 3B for catching beneath the retention tab 208 of the magazine. In this normal default position of the lever 103, the stop lug 142 juts rearwardly from the remainder of the lever at an elevation below the shaft 130 and abuts against the rear wall 120 of the support member cavity 122 to block pivotal movement of the lever 103 past this normal default position in the spring-biased direction. Further pivoting in the spring-biased direction would require rearward and upward displacement of the stop lug 142, which is blocked by contact between the distal end of the stop lug 142 and the rear cavity wall 120. The rear wall of the cavity may limit pivoting of the lever in this magazine-releasing direction as well, not by contact with the stop lug 142, but rather by the fact that sufficient pivoting of lever in the reverse direction will eventually bring the rear side of the upper portion of the lever into contact with the upper half of the rear cavity wall. Each side plate terminates short of the lower end 103B of the lever, as defined by the lower rear end of the main plate 136 thereof, whereby the remaining end portion of the main plate 136 is left exposed for thumb-effected actuation with the magazine gripping hand of the user during removal of a magazine. Pushing forward on the rear lower end 103B of the lever 103 against the bias of the torsion spring 134 pivots the forward upper end 103A of the lever rearwardly out from under the retention tab 108 of the magazine, thereby withdrawing the forward upper end 103A of the lever 103 into the internal cavity 122 of the support member 102.

As shown, the retention tab 208 of the magazine features an angled upper side 208A that slopes obliquely upward from the flat underside 208B of the tab 208 in order to join back up to the rear wall of the ammunition compartment 204. Accordingly, insertion of the front end of the magazine into engagement with the original or modified anchor hook 84 in the magazine-accommodating opening 82 of the carbine, followed by upward lifting of the tab-equipped ammunition compartment 204 toward the magazine-accommodating opening 82, pushes the angled upper side 208A of the retention tab against the main plate 136 of the lever 103 at the forward facing outer surface thereof. This pivots the lever in the release direction opposing the spring bias, which urges the forward upper end 103A of the lever rearward into the cavity 122 of the support member 102 to allow continued upward motion of the magazine into its fully seated position. As the underside 208A of the retention tab 208 clears the forward upper end of the lever 103A during this insertion of the magazine, the torsion spring 134 forces the lever 103 back into its default position, thereby securing the retention tab 208 of the magazine in place atop the catch feature defined by the exposed edge of the main lever plate 136 at the forward upper end 103A of the lever 103.

The magazine release 100 described above solves the shortcomings of the prior art by incorporating a release lever that utilizes a thumb-actuated forward-pushing motion verses a rearward pulling motion. This in turn makes magazine changes easier using the aforementioned detachable after-market magazines or a variation of the duckbill-less magazine modification. The magazine release replaces the original manufacture's magazine cover latch 12 and uses the same sear spring 62 so as to keep the reliability and safety of the original trigger design. Installation of the tactical magazine release is simple and, other than the removal of the original slide latch, requires no modification to the original trigger assembly of the SKS Carbine.

To install the magazine release, the installer places the SKS carbine on safe, and in a known manner, uses a punch to depress a detent at the rear of the trigger guard 22 that releases the trigger assembly frame member 14 from the receiver to enable removal from the stock. Once the trigger assembly is free from the stock, the installer uses a 1/16-inch punch or similar tool to drive out the latch stop cross-pin 44 and remove the original slide latch 12, being careful not to lose the latch stop cross-pin 44 and the sear spring 62, which will normally be in a partially compressed state prior to removal. Once the latch stop cross-pin 44 and the slide latch 12 are removed, the magazine release 100 can be installed.

First, the installer places the sear spring 62 in the longitudinal bore 138 in the rear end of the upper portion of the support body 102, and then slides the upper portion of the support body 102 into the channel of the trigger assembly frame member 14 at the open front end thereof. With the support body 102 held in place to align the transverse through-hole 110A, 110B, 112 thereof in alignment with the corresponding holes 46A, 46B in the side walls 18A, 18B of the trigger assembly frame member 14, the removed latch stop cross-pin 44 is re-inserted into these aligned holes and tapped back into place, ensuring that the ends of the latch stop cross-pin 44 project from the side walls of the trigger assembly frame member 14 by equal distances so as to fit back into the trigger assembly opening in the stock. At this point, the installer reinstalls the trigger assembly in the SKS carbine by positioning the trigger assembly back into the receiver via the trigger assembly opening in the stock, and firmly pressing the trigger assembly down to re-engage the detent. The safety must be "ON", for the trigger assembly to latch securely in the receiver. Next, the installer performs a function check. With the firearm on safe, the installer checks to make sure the firearm is "unloaded". The bolt carrier is pulled to the full rearward position and the charging handle is let go, thereby "closing the action". The installer takes the firearm off safe, and depresses the trigger, listening for the hammer to fall against the bolt and firing pin to confirm proper operation.

At this point, the installation of the SKS tactical magazine release 100 is complete. The installer then checks to see that the chosen magazine fits and functions in the firearm. If using modified magazines, some minor fitting may be required. With the magazine release 100 installed, the resulting tactical SKS is ready for use at a firing range, where the user can enjoy changing magazines in a similar manner to newer tactical rifles on the market.

Since various modifications can be made in my invention as herein above described, and many apparently widely different embodiments of same made within the scope of the claims without departure from such scope, it is intended that all matter contained in the accompanying specification shall be interpreted as illustrative only and not in a limiting sense.

The invention claimed is:

1. A magazine release for installation on a carbine in place of an existing sliding latch for an original clamshell magazine of said carbine to enable use of a removable magazine in place of said clamshell magazine, the magazine release comprising:

a support member having an upper portion configured for coupling to a trigger assembly frame of the carbine in place of the existing sliding latch;

a lever pivotally supported on the support member at a lower portion thereof disposed beneath the upper portion so as to carry the lever beneath the trigger assembly frame of the carbine, the lever being pivotal about an axis that lies transversely of a longitudinal barrel direction of the carbine when the support member is coupled thereto, and the lever being manually pivotable in a release direction moving a catch feature rearwardly in the longitudinal barrel direction out of a default positon into which said catch feature is biased forwardly in the longitudinal barrel direction toward a magazine-accepting opening in the carbine to catch under a retention feature of the removable magazine received therein, whereby the catch feature normally retains the removable magazine in place until the lever is pivoted in the release direction; and wherein the upper portion of the support member comprises a longitudinal bore therein that lies parallel to the longitudinal barrel direction of the carbine when the support member is coupled thereto, the longitudinal bore extending into the upper portion of the support member from a rear end thereof that faces away from the magazine-accommodating opening of the carbine in the longitudinal barrel direction thereof, the longitudinal bore being sized to accommodate receipt of a sear spring of the carbine therein.

2. The magazine release of claim 1 wherein the upper portion of the support member comprises a transverse through-hole therein that lies transversely of the longitudinal barrel direction of the carbine when the support member is coupled thereto, the transverse through-hole being sized to accommodate receipt of a latch stop pin of the carbine in order to couple the support member to the trigger assembly frame of the carbine.

3. The magazine release of claim 1 wherein the lever is rotationally biased in a default direction that is opposite to the release direction and urges an upper end of the lever forwardly in the longitudinal barrel direction.

4. The magazine release of claim 3 comprising a spring biasing the lever in the default direction around said axis.

5. The magazine release of claim 1 wherein the upper end of the lever defines the catch feature.

6. The magazine release of claim 3 wherein the support member and the lever comprise cooperating stop features that limit pivoting of the lever in the default direction to define a default position of the lever in which the lever catches under the retention feature of the removable magazine.

7. The magazine release of claim 6 wherein the lower portion of the support member comprises an interior cavity bound by two side walls and a rear wall spanning therebetween at a rear end of the cavity that lies opposite to a front end thereof from which the upper end of the lever normally projects, the lever having a stop thereon that abuts against the rear wall of the interior cavity in the default position.

8. The magazine release of claim 1 wherein the support member comprises a neck that joins the upper and lower portions together and is narrower than said upper and lower portions in a width dimension of the support member that lies transversely of the longitudinal barrel direction when the support member is coupled to the carbine.

9. In a carbine originally having a clamshell magazine retained in a closed position by a sliding latch, a magazine release installed in place of said sliding latch to enable use of a removable magazine in place of said clamshell magazine, said magazine release comprising:

a support member having an upper portion coupled to a trigger assembly frame of the carbine in place of the sliding latch adjacent a rear end of a magazine-accommodating opening of the carbine;

a lever pivotally supported on the support member at a lower portion thereof disposed beneath the trigger assembly frame of the carbine, the lever being manually pivotable in a release direction moving a catch feature rearwardly in the longitudinal barrel direction out of a default positon into which said catch feature is biased forwardly toward the magazine-accepting opening to catch under a retention feature of the removable magazine when received therein, whereby the catch feature normally retains the removable magazine in place until the lever is pivoted in the release direction; and wherein the upper portion of the support member comprises a longitudinal bore therein that lies parallel to the longitudinal barrel direction of the carbine, the longitudinal bore extending into the upper portion of the support member from a rear end thereof that faces away from the magazine- accommodating opening of the carbine in the longitudinal barrel direction thereof the longitudinal bore receiving a sear spring of the carbine therein.

10. The magazine release of claim 9 wherein the upper portion of the support member comprises transverse through-hole therein that lies transversely of the longitudinal barrel direction of the carbine, the transverse through-hole receiving therein a latch stop pin of the carbine by which the support member is coupled to the trigger assembly frame of the carbine.

11. The magazine release of claim 9 wherein the lever is rotationally biased in a default direction that is opposite to the release direction and urges an upper end of the lever forwardly in the longitudinal barrel direction.

12. The magazine release of claim 11 comprising a spring biasing the lever in the default direction around said axis.

13. The magazine release of claim 9 wherein the upper end of the lever defines the catch feature.

14. The magazine release of claim 9 wherein the support member and the lever comprise cooperating stop features that limit pivoting of the lever in the default direction to define a default position of the lever in which the lever catches under the retention feature of the removable magazine.

15. The magazine release of claim 14 wherein the lower portion of the support member comprises an interior cavity bound by two side walls and a rear wall spanning therebetween at a rear end of the cavity that lies opposite to a front end thereof from which the upper end of the lever normally projects, the lever having a stop thereon that abuts against the rear wall of the interior cavity in the default position.

16. The magazine release of claim 9 wherein the support member comprises a neck that joins the upper and lower portions together and is narrower than said upper and lower portions in a width dimension of the support member that lies transversely of the longitudinal barrel direction of the carbine.

17. A method of adapting a carbine with a clamshell magazine for use with removable magazines, the method comprising replacing an existing sliding latch of the carbine with a push-lever magazine release;

inserting a sear spring of the carbine into a blind hole at a rear side of a stationary support member portion of the push-lever magazine release; and wherein the magazine release is the magazine release of claim 1.

18. The method of claim 17 comprising coupling a support member of the push-lever magazine release to a trigger assembly frame of the carbine by inserting a cross-pin through the support member at an existing cross-pin hole of the trigger assembly frame.

19. A lever support for a magazine release to be installed on a carbine in place of an existing sliding latch for an original clamshell magazine of said carbine to enable use of a removable magazine in place of said clamshell magazine, the lever support comprising an upper portion configured for coupling to a trigger assembly frame of the carbine in place of the existing sliding latch, a lower portion disposed beneath the upper portion for pivotal support of a lever of said magazine release, the lever being manually pivotable in a release direction moving a catch feature rearwardly out of a default position into which the catch feature is biased forwardly, the upper portion of the support member comprises a transverse through-hole therein that lies transversely of the longitudinal barrel direction of the carbine when the support member is coupled thereto, the transverse through-hole being sized to accommodate receipt of a latch stop pin of the carbine in order to couple the support member to the trigger assembly frame of the carbine; and wherein the upper portion of the support member comprises a longitudinal bore therein that lies parallel to the longitudinal barrel direction of the carbine when the support member is coupled therelo, the longitudinal bore extending into the upper portion of the support member from a rear end thereof that faces away from the magazine-accommodating opening of the carbine in the longitudinal barrel direction thereof, the longitudinal bore being sized to accommodate receipt of a sear spring of the carbine therein.

20. The lever support of claim 19 wherein the support member comprises a neck that joins the upper and lower portions together and is narrower than said upper and lower portions in a width dimension of the support member that lies transversely of the longitudinal barrel direction when the support member is coupled to the carbine.

* * * * *